US009905909B2

(12) United States Patent
Liou et al.

(10) Patent No.: US 9,905,909 B2
(45) Date of Patent: Feb. 27, 2018

(54) ANTENNA MODULE AND WIRELESS COMMUNICATION DEVICE USING SAME

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 188 days.

(21) Appl. No.: 14/868,551

(22) Filed: Sep. 29, 2015

(65) Prior Publication Data

US 2017/0093020 A1 Mar. 30, 2017

(51) Int. Cl.
*H01Q 1/24* (2006.01)
*H01Q 1/50* (2006.01)
*H01Q 5/328* (2015.01)

(52) U.S. Cl.
CPC ..... *H01Q 1/243* (2013.01); *H01Q 1/50* (2013.01); *H01Q 5/328* (2015.01)

(58) Field of Classification Search
CPC ..... H01Q 1/243; H01Q 1/50; H01Q 13/10
USPC ..... 343/702, 767
See application file for complete search history.

(56) References Cited

U.S. PATENT DOCUMENTS 7,079,079 B2 * 7/2006 Jo ..... H01Q 1/243 343/700 MS
2014/0078008 A1 * 3/2014 Kang ..... H01Q 5/35 343/702
2014/0266922 A1 * 9/2014 Jin ..... H01Q 21/28 343/702
2014/0266938 A1 * 9/2014 Ouyang ..... H01Q 5/321 343/729

* cited by examiner

*Primary Examiner* — Dameon E Levi
*Assistant Examiner* — Hasan Islam
(74) *Attorney, Agent, or Firm* — ScienBiziP, P.C.

(57) ABSTRACT

An antenna module includes a metallic member and a first radiating portion. The metallic member defines a slot. The slot is configured to divide the metallic member into a first metallic portion and a second metallic portion. The second metallic portion is spaced apart from the first metallic portion. The first radiating portion is positioned in the second metallic portion and is spaced apart from the second metallic portion. The first metallic portion is grounded. The first radiating portion is configured to receive a current signal and couple the current signal to the second metallic portion. The second metallic portion and the first metallic portion are configured to cooperatively activate a plurality of resonating modes through the slot.

18 Claims, 8 Drawing Sheets

ANTENNA MODULE AND WIRELESS COMMUNICATION DEVICE USING SAME

FIELD

The subject matter herein generally relates to an antenna module and a wireless communication device using same.

BACKGROUND

Metal housings are widely used for wireless communication devices, such as mobile phones or personal digital assistants (PDAs). Antennas are also important components in the wireless communication devices to receive/transmit wireless signals at different frequencies, such as wireless signals operated in a long term evolution (LTE) band. However, the signal of the antenna located in the metal housing is often shielded by the metal housing.

BRIEF DESCRIPTION OF THE DRAWINGS

Implementations of the present technology will now be described, by way of example only, with reference to the attached figures.

DETAILED DESCRIPTION

Figure 1:
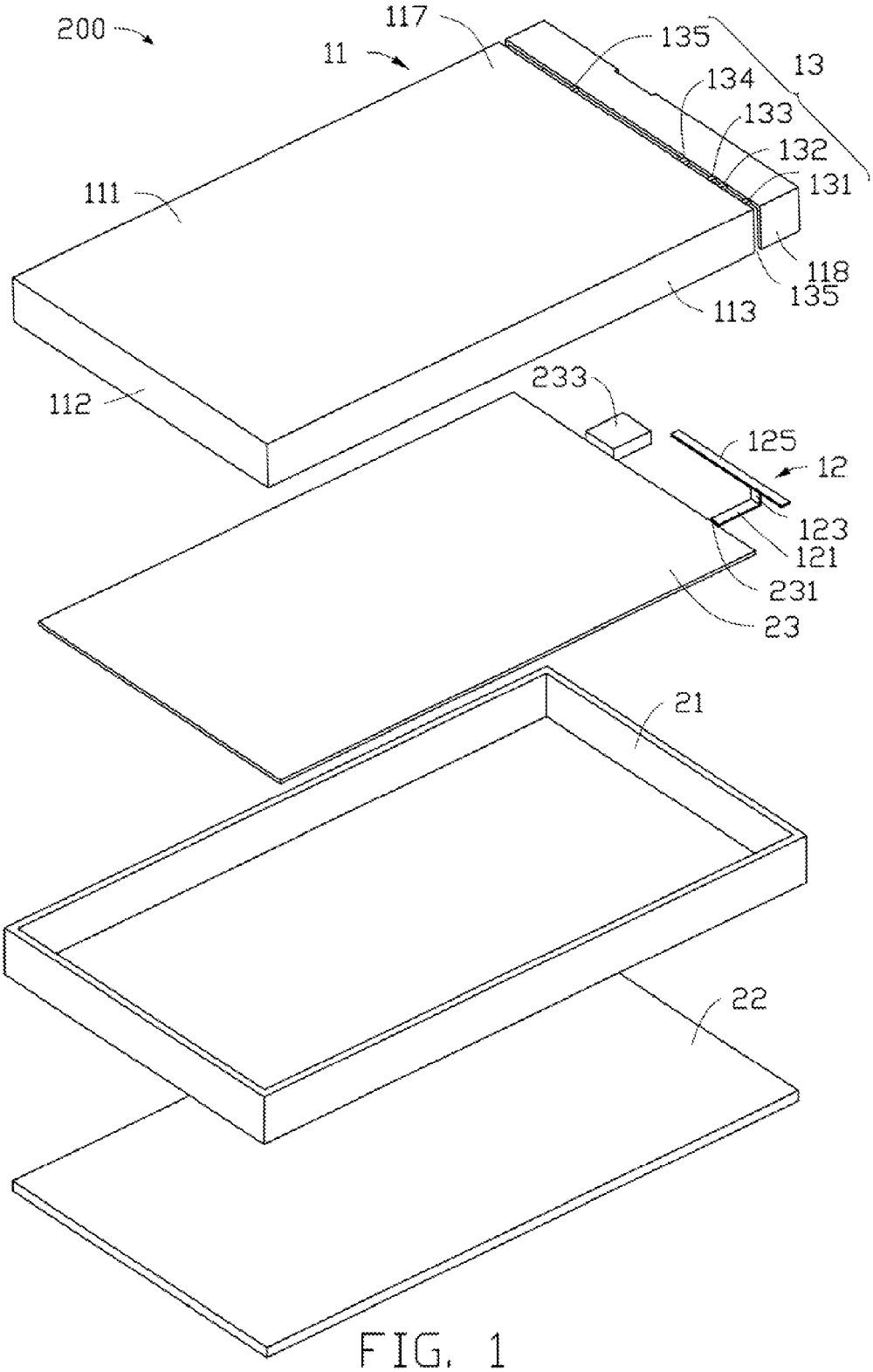
FIG. 1 is an exploded, isometric view of an embodiment of a wireless communication device employing an antenna module.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna module and a wireless communication device using same.

Figure 2:
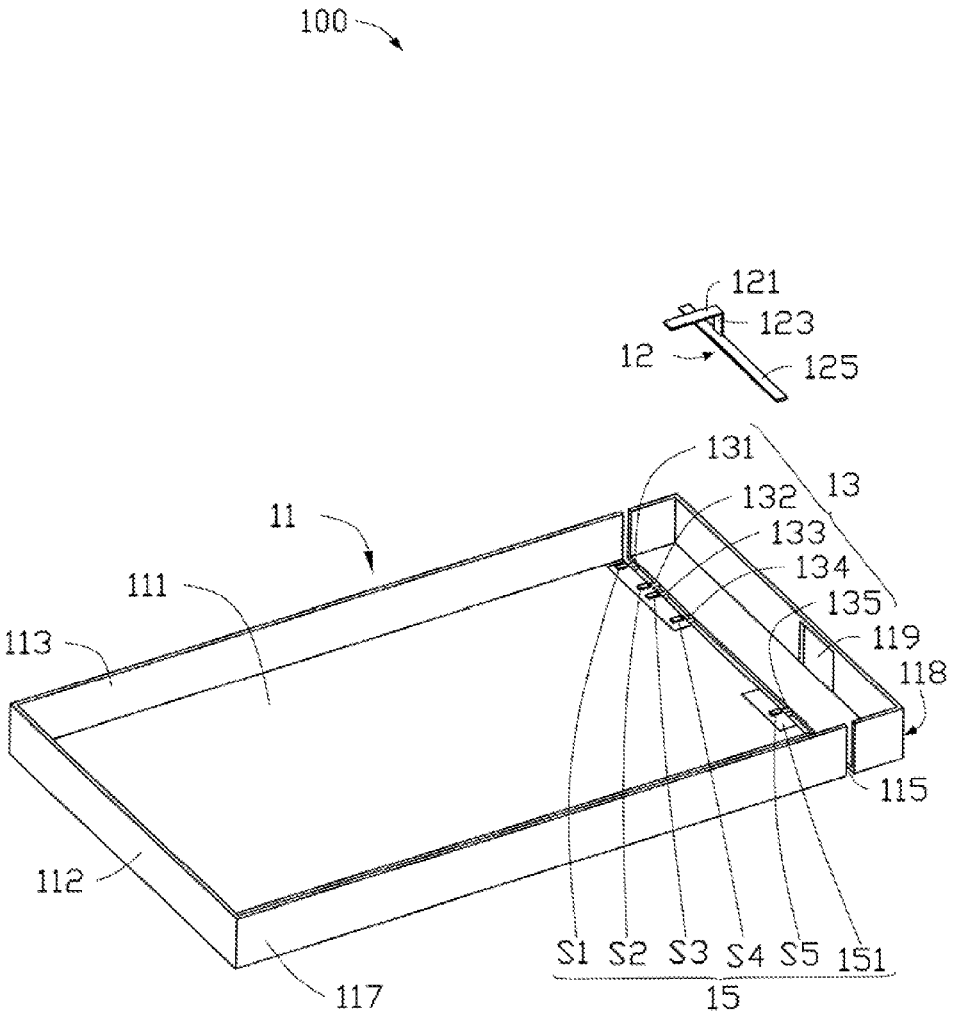
FIG. 2 is an exploded, isometric view of the antenna module of FIG. 1.

FIG. 1 illustrates an embodiment of a wireless communication device 200 employing an antenna module 100 (see FIG. 2). The wireless communication device 200 can be a mobile phone or a personal digital assistant, for example (details not shown). The wireless communication device 200 further includes a main portion 21, a display unit 22, and a baseboard 23.

The display unit 22 is positioned on one surface of the main portion 21. The baseboard 23 can be made of a dielectric material, such as glass epoxy phenolic fiber (FR4). The baseboard 23 is positioned inside the main portion 21 and includes a signal feed point 231 and a system grounding plane (not shown). The system grounding plane is configured to ground the antenna module 100. One side of the baseboard 23 further includes an electronic component 233. In this embodiment, the electronic component 233 is a universal serial bus (USB) interface module and is electrically connected to the baseboard 23.

Figure 3:
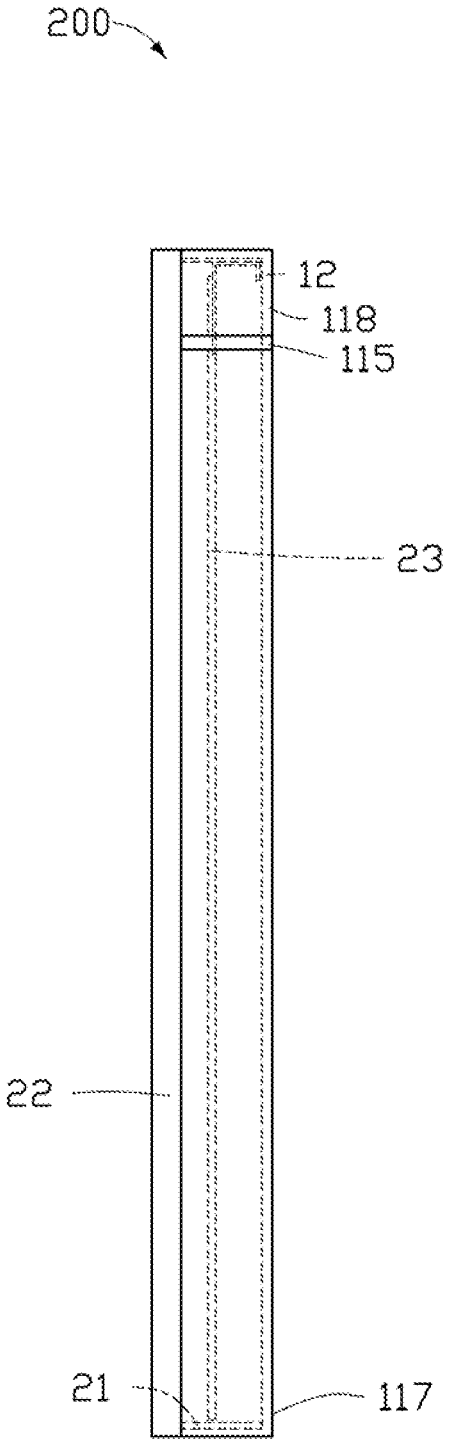
FIG. 3 is a diagrammatic view of the wireless communication device of FIG. 1.

The antenna module 100 includes a metallic member 11, a first radiating portion 12, a connecting unit 13, and a switching unit 15 (shown in FIG. 2). The metallic member 11 may be a metallic sheet or a metallic conductive layer formed on a plastic housing through a sputtering manner or the like. As illustrated in FIG. 3, in this embodiment, the metallic member 11 is a battery cover of the communication wireless device 200 and is positioned on another surface of the main portion 21 opposite to the display unit 22.

The metallic member 11 is a housing with one end opened and includes a top surface 111, two opposite first side surfaces 112, and two opposite second side surfaces 113. The first side surfaces 112 and the second side surfaces 113 are all located on a peripheral edge of the top surface 111. In this embodiment, the first side surfaces 112 and the second side surfaces 113 can be flat or curved shape. In this embodiment, the metallic member 11 further defines a slot 115. The slot 115 is defined on the top surface 111 and extends through the two second side surfaces 113, such that the metallic member 11 is divided into a first metallic portion 117 and a second metallic portion 118 spaced apart with the first metallic portion 117. The slot 115 has a width of about 0.5 mm to about 1.5 mm. In this embodiment, the width of the slot 115 is about 0.5 mm.

In this embodiment, the first metallic portion 117 of the metallic member 11 acts as a ground portion of the antenna module 100, and is electrically connected to the system grounding plane of the baseboard 23 through feeder, probe, shrapnel, or the like. The second metallic portion 118 of the metallic member 11 acts as a second radiating portion of the antenna module 100.

In other embodiments, the metallic member 11 further defines an opening 119 (shown in FIG. 2) corresponding to the electronic component 233. In this embodiment, the opening 119 is defined on one first side surface 112 of the second metallic portion 118. The electronic component 233 can expose out from the opening 119, such that a USB device can pass through the opening 119 and be inserted into the electronic component 233, thereby establishing a connection between the USB device and the wireless communication device 200.

The first radiating portion 12 is located in an interior of the second metallic portion 118 and is spaced apart with the second metallic portion 118. The first radiating portion 12 is configured to receive a current signal, then the current signal on the first radiating portion 12 can be coupled to the second metallic portion 118 (that is, the second radiating portion of the antenna module 100). In this embodiment, a distance between the first radiating portion 12 and the second metallic portion 118 is about 0.5 mm. The first radiating portion 12 includes a feed section 121, a transition section 123, and a coupling section 125 connected in that order. The feed section 121 is configured to receive a current signal. The feed section 121 is positioned at a plane parallel to the top surface 111. In this embodiment, the feed section 121 is substantially a strip. One end of the feed section 121 is electrically connected to the signal feed point 231 through feeder, probe, shrapnel, or the like, thereby feeding current for the antenna module 100.

The transition section 123 is positioned at a plane perpendicular to the top surface 111. In this embodiment, the transition section 123 is substantially a strip. One end of the transition section 123 is perpendicularly connected to one end of the feed section 121 away from the signal feed point 231. The other end of the transition section 123 extends towards the top surface 111.

The coupling section 125 is positioned at a plane parallel to the top surface 111. In this embodiment, the coupling section 125 is substantially a strip. The coupling section 125 is perpendicularly connected to the end of the transition section 123 away from the feed section 121 and extends towards the two second side surfaces 113.

In other embodiments, the coupling section 125 can also be positioned at a plane where the transition section 123 is positioned, that is, the coupling section 125 can be coplanar with the transition section 123 and only to ensure that the first radiating portion 12 is spaced apart with the second metallic portion 118. The coupling section 125 is spaced apart from the top surface 111 and/or the first side surfaces 112. In addition, the feed section 121, the transition section 123, and the coupling section 125 are not limited to be strips, which can also be other shape. For example, the feed section 121 is substantially L-shaped. Two sides of the transition section 123 define a plurality of openings, then the transition section 123 is substantially square-wave shaped. The coupling section 125 is substantially a strip, but only extends towards one of the second side surfaces 113.

In this embodiment, the connecting unit 13 includes five connecting portions 131, 132, 133, 134, 135. The connecting portions 131, 132, 133 function as low-frequency connecting portions and the connecting portions 134, 135 function as high-frequency connecting portions. The five connecting portions 131-135 are all positioned at one edge of the second metallic portion 118 near the opening 115 and are electrically connected between the second metallic portion 118 and the switching unit 15.

It can be understood that the five connecting portions 131-135 can be flexible printed circuit (FPC) or other conductive structures. Also, a number of the connecting portions is not limited to be five, which can be adjusted according to a need of the user. For example, the connecting unit 13 includes four connecting portions. One connecting portion acts as a high-frequency connecting portion, and the other connecting portions act as low-frequency connecting portions. It can be understood that when only a high-frequency band or a low-frequency band of the antenna module 100 needs to be adjusted, the low-frequency connecting portion or the high-frequency connecting portion can be omitted, that is, only one or more than one high-frequency connecting portions or only one or more than one low-frequency connecting portions are needed.

As illustrated in FIG. 2, in this embodiment, the switching unit 15 includes two conductive portions 151 and five switches S1, S2, S3, S4, S5. The conductive portions 151 may be FPC or a flex and rigid combination board. The two conductive portions 151 are positioned on the first metallic portion 117 and are electrically connected to the first metallic portion 117. The switches S1-S5 are divided into two groups and each group is positioned on one corresponding conductive portion 151. The switches S1-S5 are electrically connected to the first metallic portion 117 through the conductive portions 151 and are electrically connected to corresponding high-frequency connecting portions and corresponding low-frequency connecting portions. For example, the switches S1-S4 are positioned on one conductive portion 151 and are electrically connected to the first metallic portion 117 through the one conductive portion 151. The switches S1-S4 establish a corresponding one-to-one electronic connection with the connecting portions 131-134. The switch S5 is positioned on the other conductive portion 151 and is electrically connected to the first metallic portion 117 through that conductive portion 151. The switch S5 establishes an electronic connection with the corresponding connecting portion 135.

Then, when the switches S1-S5 are turned on or turned off, the first metallic portion 117 connects with or disconnects with the second metallic portion 118 at different locations, thereby forming different current paths. The antenna module 100 therefore can works at different frequency bands, and which can effectively adjust a bandwidth of the antenna module 100. In this embodiment, each of the switches S1-S5 corresponds to a different frequency band. When one of the switches S1-S5 is turned on and the other switches are turned off, the antenna module 100 can works at the frequency band corresponding to the switch that is turned on.

For example, as illustrated at table 1, when the switch S1 is turned on, other switches S2, S3, S4, S5 are turned off, the antenna module 100 can work at a first frequency band, that is LTE band17 (704-746 MHz). When the switch S2 is turned on, other switches S1, S3, S4, S5 are turned off, the antenna module 100 can work at a second frequency band, that is GSM850 (824-894 MHz). When the switch S3 is turned on, other switches S1, S2, S4, S5 are turned off, the antenna module 100 can work at a third frequency band, that is GSM900 (880-960 MHz). When the switch S4 is turned on, other switches S1, S2, S3, S5 are turned off, the antenna module 100 can work at a fourth frequency band, that is LTE band7 (2300-2690 MHz). When the switch S5 is turned on, other switches S1, S2, S3, S4 are turned off, the antenna module 100 can work at a fifth frequency band, that is GSM1800/1900/UMTS2100 (1710-2170 MHz).

TABLE 1 relationship between frequency bands of the antenna module and states of the switches

| Frequency bands | Switch S1 | S2 | S3 | S4 | S5 |
|---|---|---|---|---|---|
| LTE band17 | on | off | off | off | off |
| GSM850 | off | on | off | off | off |
| GSM900 | off | off | on | off | off |
| LTE band7 | off | off | off | on | off |
| GSM1800/1900/UMTS2100 | off | off | off | off | on |

In other embodiments, a number of the conductive portions 151 is not limited to be two, it can also be one, then the switches S1-S5 are all positioned on the conductive portion 151.

Figure 4:
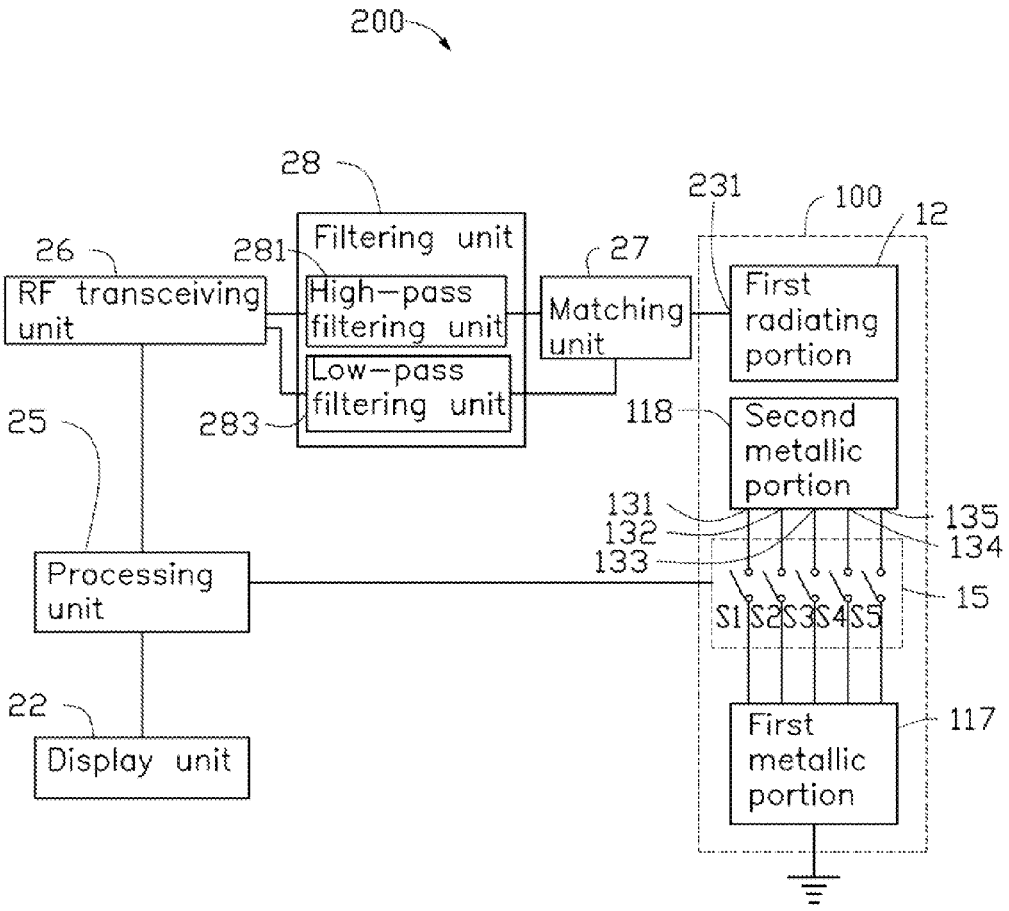
FIG. 4 is a block diagram of the wireless communication device of FIG. 1.

FIG. 4 illustrates that the wireless communication device 200 further includes a processing unit 25, a radio frequency (RF) transceiving unit 26, a matching unit 27, and a filtering unit 28. The processing unit 25 is positioned on the baseboard 23 and is electrically connected to the display unit 22, the RF transceiving unit 26, and the switches S1-S5. The processing unit 25 is configured to output control signals to the switches S1-S5 positioned on the conductive portions 151 to turn on or turn off the switches S1-S5.

The matching unit 27 is electrically connected to the signal feed point 231 and the RF transceiving unit 26. The matching unit 27 is configured to match an impedance of the antenna module 100 for optimizing performance of the antenna module 100.

The filtering unit 28 includes a high-pass filtering unit 281 and a low-pass filtering unit 283. The high-pass filtering unit 281 and the low-pass filtering unit 283 are both electrically connected to the RF transceiving unit 26 and the matching unit 27 for separating the high-frequency portion and the low-frequency portion of RF signals transmitted from the antenna module 100 and RF signals received by the antenna module 100.

When current is input to the signal feed point 231, the current flows to the first radiating portion 12, and is coupled to the second metallic portion 118 from the first radiating portion 12. The second metallic portion 118 and the first metallic portion 117 cooperatively activate a plurality of resonating modes through the slot 115 therebetween. In addition, the processing unit 25 outputs a corresponding controlling signal to the switching unit 15 to turn on or turn off the switches S1-S5, thereby adjusting a bandwidth of the antenna module 100. In this embodiment, the antenna module 100 can at least work at communication systems of LTE band17 (704-746 MHz), GSM850 (824-894 MHz), GSM900 (880-960 MHz), LTE band7 (2300-2690 MHz), and GSM1800/1900/UMTS2100 (1710-2170 MHz).

Figure 5:
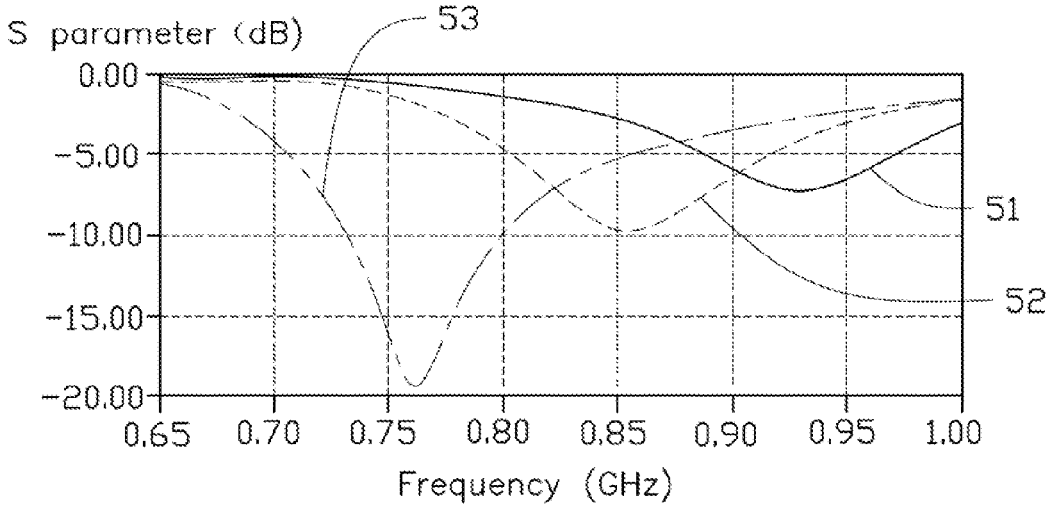
FIG. 5 is a scattering parameter graph of the antenna module of FIG. 1, showing the antenna module operated in a low-frequency band.
Figure 6:
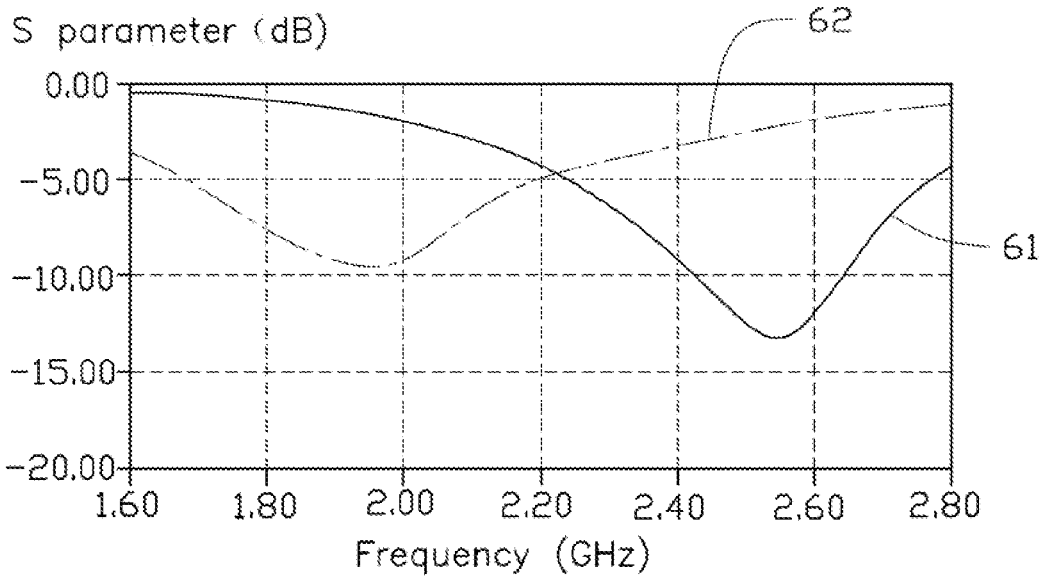
FIG. 6 is similar to FIG. 5, but showing the antenna module operated in a high-frequency band.

FIG. 5 illustrates a scattering parameter graph of the antenna module 100, showing the antenna module 100 in a low frequency band. FIG. 6 illustrates a scattering parameter graph of the antenna module 100, showing the antenna module 100 in a high frequency band. Curve 51 illustrates a working frequency of the antenna module 100 when the switch S3 is turned on and the other switches S1, S2, S4, S5 are turned off. Curve 52 illustrates a working frequency of the antenna module 100 when the switch S2 is turned on and the other switches S1, S3, S4, S5 are turned off. Curve 53 illustrates a working frequency of the antenna module 100 when the switch S1 is turned on and the other switches S2, S3, S4, S5 are turned off. Curve 61 illustrates a working frequency of the antenna module 100 when the switch S4 is turned on and the other switches S1, S2, S3, S5 are turned off. Curve 62 illustrates a working frequency of the antenna module 100 when the switch S5 is turned on and the other switches S1, S2, S3, S4 are turned off.

In view of the curves 51-53 and 61-62, the antenna module 100 has good performance when operating at LTE band17 (704-746 MHz), GSM850 (824-894 MHz), GSM900 (880-960 MHz), LTE band7 (2300-2690 MHz), and GSM1800/1900/UMTS2100 (1710-2170 MHz).

Figure 7:
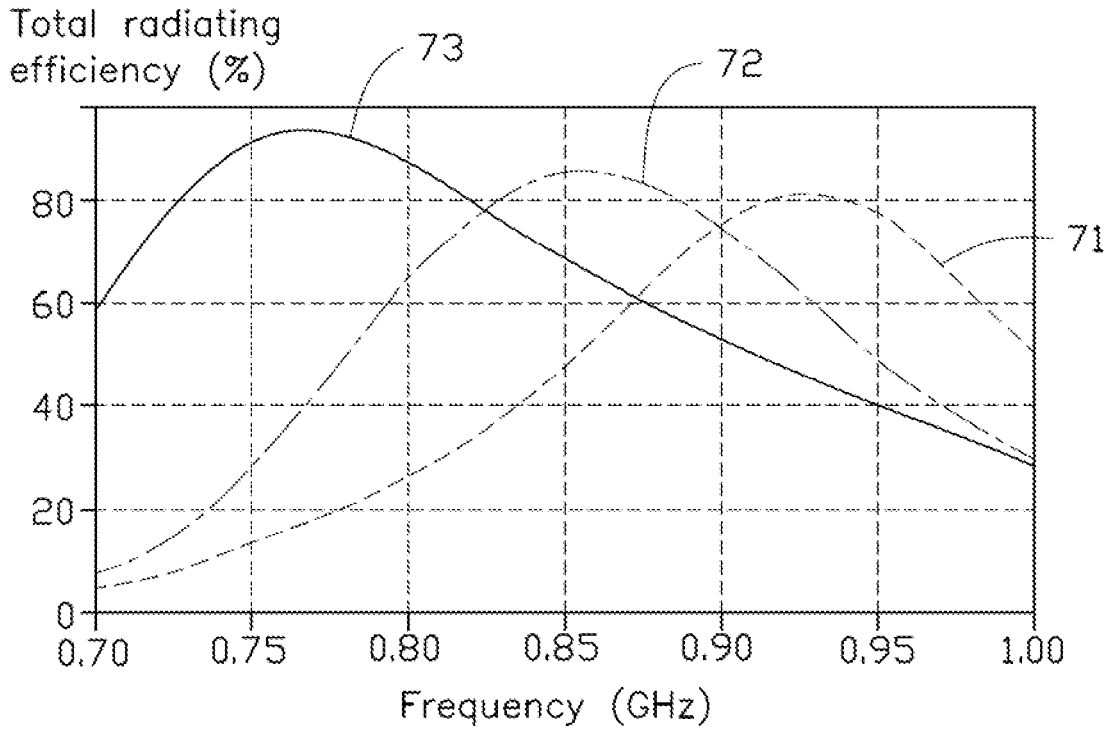
FIG. 7 is a total radiating efficiency graph of the antenna module of FIG. 1, showing the antenna module operated in a low-frequency band.
Figure 8:
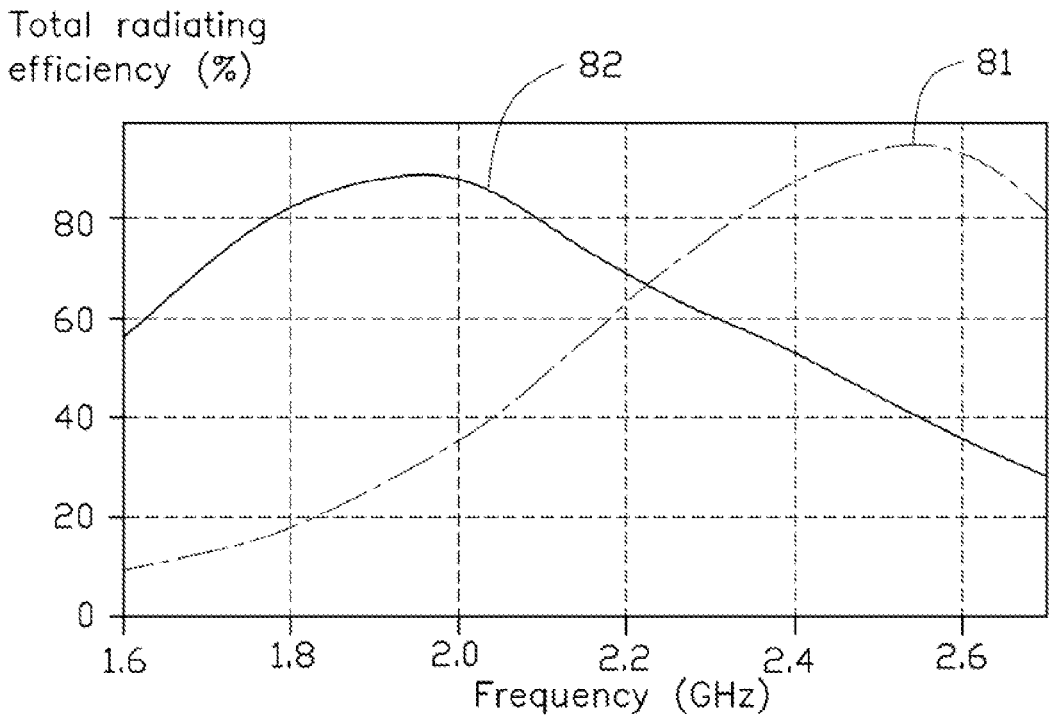
FIG. 8 is similar to FIG. 7, but showing the antenna module operated in a high-frequency band.

FIG. 7 illustrates a total radiating efficiency graph of the antenna module 100, showing the antenna module 100 in a low frequency band. FIG. 8 illustrates a total radiating efficiency graph of the antenna module 100, showing the antenna module 100 in a high frequency band. Curve 71 illustrates a total radiating efficiency of the antenna module 100 when the switch S3 is turned on and the other switches S1, S2, S4, S5 are turned off. Curve 72 illustrates a total radiating efficiency of the antenna module 100 when the switch S2 is turned on and the other switches S1, S3, S4, S5 are turned off. Curve 73 illustrates a total radiating efficiency of the antenna module 100 when the switch S1 is turned on and the other switches S2, S3, S4, S5 are turned off. Curve 81 illustrates a total radiating efficiency of the antenna module 100 when the switch S4 is turned on and the other switches S1, S2, S3, S5 are turned off. Curve 82 illustrates a total radiating efficiency of the antenna module 100 when the switch S5 is turned on and the other switches S1, S2, S3, S4 are turned off.

In view of the curves 71-73 and 81-82, when the antenna module 100 operates at LTE band17 (704-746 MHz), GSM850 (824-894 MHz), GSM900 (880-960 MHz), LTE band7 (2300-2690 MHz), and GSM1800/1900/UMTS2100 (1710-2170 MHz), the total radiating efficiency of the antenna module 100 is above 60%, which satisfies design standard of the antenna.

The embodiments shown and described above are only examples. Many details are often found in the art such as the other features of the antenna module and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna module comprising:

a metallic housing with one end opened and comprising a top surface, two opposite first side surfaces, and two opposite second side surfaces; the first side surfaces and the second side surfaces all located on a peripheral edge of the top surface; the metallic housing further defining a slot, wherein the slot is defined on the top surface and extends through the two second side surfaces, the slot is configured to divide the metallic housing into a first metallic member and a second metallic member, the second metallic member is spaced apart from the first metallic member; and a first radiating antenna positioned in the second metallic member and spaced apart from the second metallic member;

wherein the first metallic member is grounded, the first radiating antenna is configured to receive a current signal and couple the current signal to the second metallic member, and the second metallic member and the first metallic member are configured to cooperatively activate a plurality of resonating modes through the slot.

2. The antenna module of claim 1, wherein the housing is one of a metallic sheet, a metallic conductive layer formed on a plastic housing, and a battery cover of a wireless communication device.

3. The antenna module of claim 1, wherein the first radiating member comprises a feed section, a transition section, and a coupling section connected in that order, the feed section is positioned at a plane parallel to the top surface, the feed section is configured to receive the current signal; the transition section is positioned at a plane perpendicular to the top surface, one end of the transition section is perpendicularly connected to one end of the feed section, the other end of the transition section extends towards the top surface, the coupling section is perpendicularly connected to the other end of the transition section.

4. The antenna module of claim 3, wherein the coupling section is positioned at a plane parallel to the top surface or at a plane where the transition section is positioned.

5. The antenna module of claim 3, wherein the coupling section is spaced apart from one of the top surface and the first side surfaces.

6. The antenna module of claim 1, further comprising a connecting unit and a switching unit, the connecting unit comprises a plurality of connecting portions, the plurality of connecting portions is electrically connected to the second metallic member, the switching unit comprising a plurality of switches, the plurality of switches electrically connects the connecting portions and the first metallic member, a working frequency band of the antenna module is switched through turning the switches on or off.

7. The antenna module of claim 6, wherein each of the switches corresponds to a different working frequency band, when one of the switches is turned on and the other switches are turned off, the antenna module works at the working frequency band corresponding to the switch that is turned on.

8. A wireless communication device, comprising:

a main portion;

a display unit positioned at one surface of the main portion; and an antenna module comprising:

a metallic housing positioned at another surface of the main portion opposite to the display unit, the metallic housing having one end opened and comprising a top surface, two opposite first side surfaces, and two opposite second side surfaces; the first side surfaces and the second side surfaces all located on a peripheral edge of the top surface; the metallic housing further defining a slot, the slot is configured to divide the metallic housing into a first metallic member and a second metallic member, the second metallic member is spaced apart from the first metallic member; and a first radiating antenna positioned in the second metallic member and spaced apart from the second metallic member;

wherein the first metallic member is grounded, the first radiating antenna is configured to receive a current signal and couple the current signal to the second metallic member, and the second metallic member and the first metallic member are configured to cooperatively activate a plurality of resonating modes through the slot.

9. The wireless communication device of claim 8, wherein the metallic housing is one of a metallic sheet, a metallic conductive layer formed on a plastic housing, and a battery cover of the wireless communication device.

10. The wireless communication device of claim 8, wherein the first radiating member comprises a feed section, a transition section, and a coupling section connected in that order, the feed section is positioned at a plane parallel to the top surface, the feed section is configured to receive the current signal; the transition section is positioned at a plane perpendicular to the top surface, one end of the transition section is perpendicularly connected to one end of the feed section, the other end of the transition section extends towards the top surface, the coupling section is perpendicularly connected to the other end of the transition section.

11. The wireless communication device of claim 10, wherein the coupling section is positioned at a plane parallel to the top surface or at a plane where the transition section is positioned.

12. The wireless communication device of claim 10, wherein the coupling section is spaced apart from one of the top surface and the first side surfaces.

13. The wireless communication device of claim 8, further comprising a baseboard, wherein the baseboard is positioned inside the main member and comprises a signal feed point and a system grounding plane, the signal feed point is electrically connected to the first radiating antenna, and the first metallic portion is electrically connected to the system grounding plane.

14. The wireless communication device of claim 8, further comprising a connecting unit and a switching unit, the connecting unit comprises a plurality of connecting portions, the plurality of connecting portions is electrically connected to the second metallic member, the switching unit comprising a plurality of switches, the plurality of switches electrically connects the connecting portions and the first metallic member, a working frequency band of the antenna module is switched through turning the switches on or off.

15. The wireless communication device of claim 14, further comprising a processing unit, wherein the processing unit is electrically connected to the display unit and the switching unit and is configured to output control signals to turn on or turn off the switches of the switching unit.

16. The wireless communication device of claim 15, wherein each of the switches corresponds to a different working frequency band, when one of the switches is turned on and the other switches are turned off, the antenna module works at the working frequency band corresponding to the switch that is turned on.

17. The wireless communication device of claim 15, further comprising a radio frequency (RF) transceiving unit and a matching unit, wherein the transceiving unit is electrically connected to the processing unit, the matching unit is electrically connected to the RF transceiving unit and the first radiating portion and is configured to match an impedance of the antenna module.

18. The wireless communication device of claim 15, further comprising a filtering unit, wherein the filtering unit comprises a high-pass filtering unit and a low-pass filtering unit, the high-pass filtering unit and the low-pass filtering unit are both electrically connected to the RF transceiving unit and the matching unit for separating a high-frequency portion and a low-frequency portion of RF signals transmitted from the antenna module and RF signals received by the antenna module.

* * * * *